US007160214B1

(12) United States Patent
Rome

(10) Patent No.: US 7,160,214 B1
(45) Date of Patent: Jan. 9, 2007

(54) PORTABLE BACKSTOP GAME APPARATUS

(76) Inventor: Thomas E. Rome, 510 Franklin Ter., Wyckoff, NJ (US) 07481

( * ) Notice: Subject to any disclaimer, the term of this patent is extended or adjusted under 35 U.S.C. 154(b) by 29 days.

(21) Appl. No.: 10/998,075

(22) Filed: Nov. 26, 2004

Related U.S. Application Data

(60) Provisional application No. 60/525,516, filed on Nov. 26, 2003.

(51) Int. Cl.
*A63B 63/00* (2006.01)
*A63B 69/00* (2006.01)
*A63B 67/00* (2006.01)

(52) U.S. Cl. ..... 473/454; 473/446; 473/471; 273/348

(58) Field of Classification Search ..... 473/197, 473/434, 435, 454, 462, 470, 471, 415, 476–478, 473/446; 273/348, 410, 402
See application file for complete search history.

(56) References Cited

U.S. PATENT DOCUMENTS 2,873,969 A * 2/1959 Ziel ..... 473/456
4,815,153 A * 3/1989 Bleser et al. ..... 5/98.1
5,269,623 A * 12/1993 Hanson ..... 404/6
5,462,505 A * 10/1995 Blair et al. ..... 482/27
5,546,707 A * 8/1996 Caruso ..... 52/2.13
5,611,531 A * 3/1997 Skerlan ..... 473/454
5,720,678 A * 2/1998 Korthauer ..... 473/415
5,725,444 A * 3/1998 Heden ..... 473/446
5,906,373 A * 5/1999 Sanders ..... 273/349
5,937,586 A * 8/1999 Scherba ..... 52/2.23
5,944,318 A * 8/1999 Payton ..... 273/402
6,008,938 A * 12/1999 Suehle et al. ..... 359/443
6,119,288 A * 9/2000 Hendrickson ..... 5/97
6,629,899 B1 * 10/2003 Chauvet et al. ..... 473/472
2002/0049103 A1 * 4/2002 Treihart ..... 473/454
2003/0236140 A1 * 12/2003 Alford ..... 473/454

* cited by examiner

*Primary Examiner*—Mitra Aryanpour
(74) *Attorney, Agent, or Firm*—Eric Karich

(57) ABSTRACT

A game apparatus is disclosed including a barrier member, a net, and a frame. The barrier member has two opposed major surfaces and an aperture passing through the opposed major surfaces. The net is positioned adjacent one of the major surfaces of the barrier member such that the net covers the aperture. The frame supports the barrier member in a generally planar and substantially vertical orientation.

4 Claims, 7 Drawing Sheets

PORTABLE BACKSTOP GAME APPARATUS

CROSS-REFERENCE TO RELATED APPLICATIONS

This application for a utility patent claims the benefit of U.S. Provisional Application No. 60/525,516, filed Nov. 26, 2003. This application is incorporated herein by reference in its entirety.

STATEMENT REGARDING FEDERALLY SPONSORED RESEARCH

Not Applicable

BACKGROUND OF THE INVENTION

1. Field of the Invention

This invention relates generally to game apparatus, and more particularly to game apparatus adapted to receive pitched objects.

2. Description of Related Art

When people desire game play involving pitched objects such as balls they usually meet with the same obstacles. Some of these obstacles are the need for a designated catcher, the lack of a sufficient backstop, and lack of a good way to define a target zone called a "strike zone."

For example, being the catcher in a Wiffle®ball game or stickball game is a rather undesirable position. (Wiffle®ball is a registered trademark of Wiffle Ball Inc., Shelton, Conn.) The movement of the pitches makes it difficult to track the path of the ball. If it's a family member or a friend acting as the pitcher, they just may not be that skilled, and the catcher has to constantly chase wild pitches. In short, being the catcher is a lot of work and not much fun.

The lack of a sufficient backstop results in delays as the catcher chases pitched balls that he or she cannot catch. As a result, players tend to lose interest, and there is no rhythm for the pitcher when the catcher is constantly chasing the ball.

In addition, the lack of an adequately defined strike zone often leads to arguments. For example, in a park, on the beach, or in a parking lot, players sometimes use a portion of a lawn chair to define the strike zone. In a driveway or on a playground, players sometimes use a box placed on a wall behind the batter to define the strike zone. When the ball strikes these objects, it tends to bounce back toward the pitcher. However, it is very difficult to determine whether the pitched ball impacted the object within the portion defining the strike zone. This often leads to disagreements between the players.

There is a need for a portable game apparatus that defines a target zone or strike zone, signals whether a pitched ball impacts within the target zone or strike zone, and tends to keep pitched objects that miss the strike zone in a defined playing area.

Known game apparatus that perform similar functions include backstops or catch nets for golfers or football players. Users can kick, throw, or drive a ball into these catch nets for training. These nets prevent the object from inconveniently or even dangerously exiting the playing area. Some of these backstops have a pop-up design, and some provide a defined target area. However, these backstops do not indicate whether a ball impacts within the target zone.

Other known game apparatus that perform similar functions include portable hockey or soccer goals. Some of these goals have pop-up designs making them somewhat portable, but are designed for hockey and/or soccer and not for game play with pitched balls.

Other known game apparatus that perform similar functions include baseball and softball training devices called "pitch backs." While strike zones may be defined in portions of these devices, they simply bounce the ball back to the pitcher, and do not indicate whether a pitched ball impacts within the strike zone. In addition, pitch backs typically have relatively heavy frames made of metal or hard plastic, and thus are not very portable.

SUMMARY OF THE INVENTION

A game apparatus is disclosed including a barrier member, a net, and a frame. The barrier member has two opposed major surfaces and an aperture passing through the opposed major surfaces. The net is positioned adjacent one of the major surfaces of the barrier member such that the net covers the aperture. The frame supports the barrier member in a generally planar and substantially vertical orientation.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
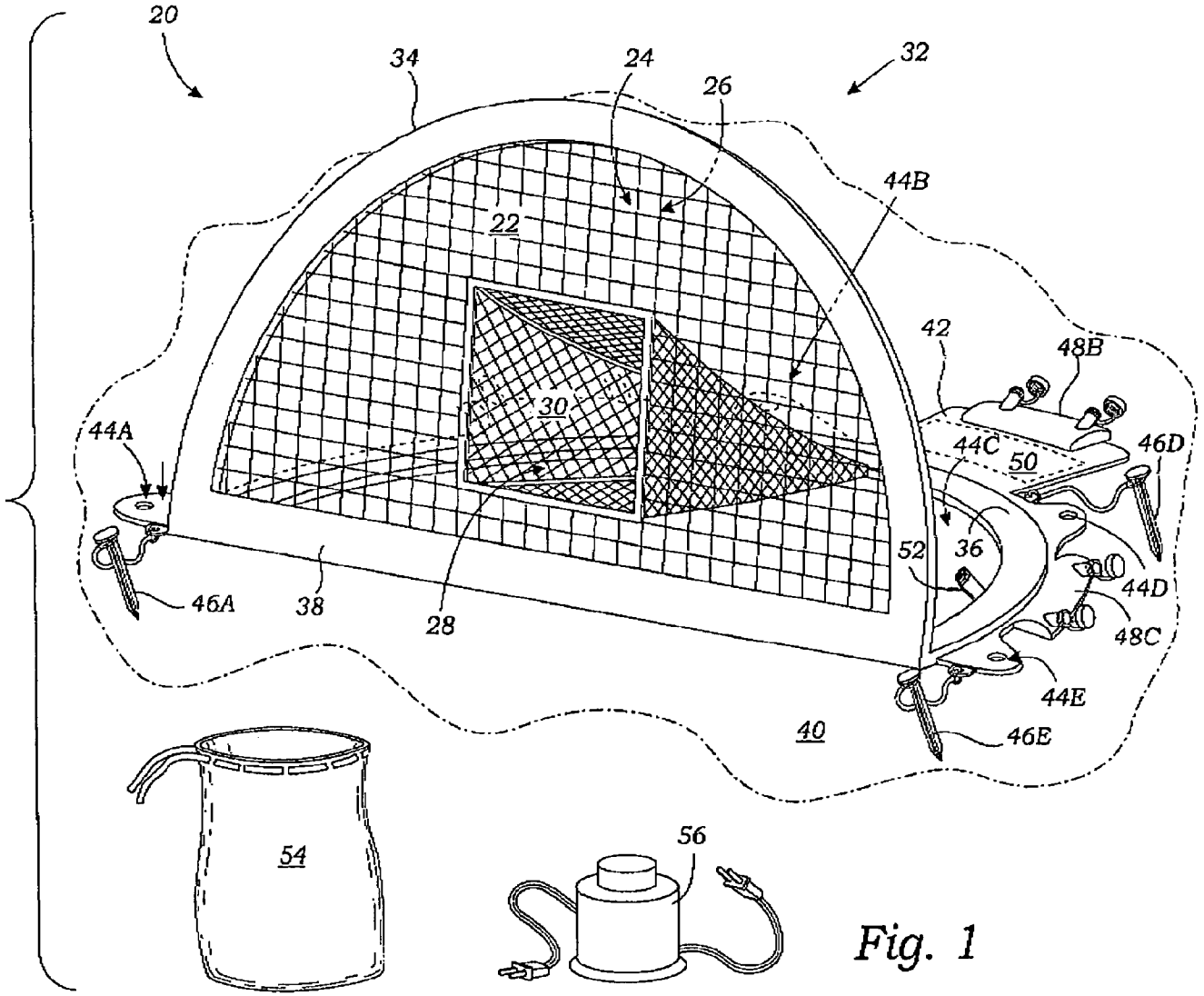
FIG. 1 is a perspective view of one embodiment of a game apparatus including a barrier member attached to a frame.
Figure 2:
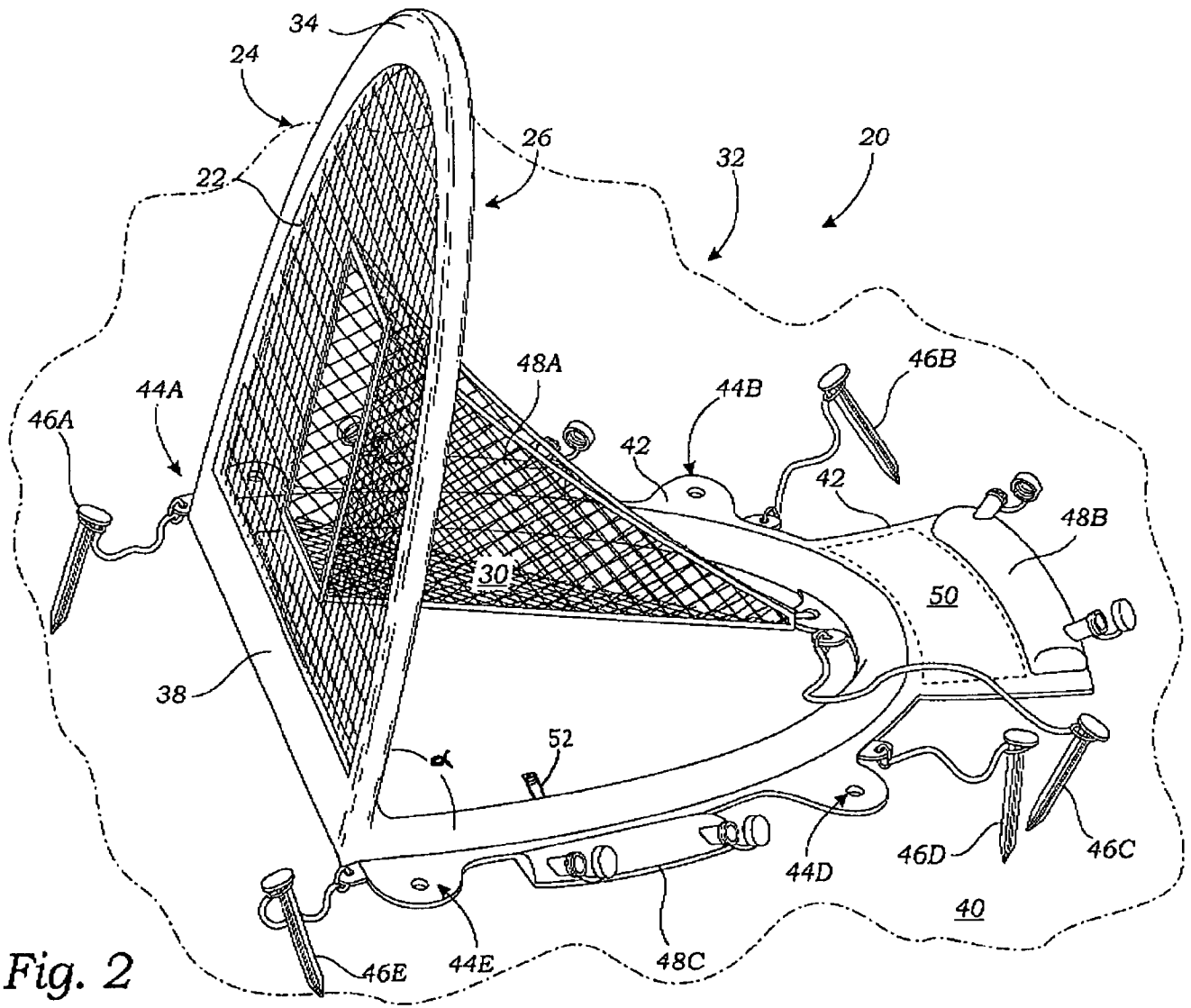
FIG. 2 is a perspective view of the game apparatus of FIG. 1 as seen from a different view point.

FIG. 1 is a perspective view of one embodiment of a game apparatus 20 including a barrier member 22 having a front surface 24 and an opposed back surface 26. FIG. 2 is a perspective view of the game apparatus 20 of FIG. 1 as seen from a different view point. Referring to FIGS. 1 and 2, an aperture 28 passes through the front surface 24 and the back surface 26 of the barrier member 22. A net 30 is positioned adjacent the back surface 26 such that the net 30 covers the aperture 28. A frame 32 supports the barrier member 22 in a generally planar and substantially vertical orientation.

In the embodiment of FIGS. 1 and 2, the game apparatus 20 is adapted to function as a backstop. A batter stands adjacent the game apparatus 20, and the front surface 24 faces a pitcher standing some distance away from the batter. The pitcher pitches a ball toward the batter. The aperture 28 is dimensioned to define a target zone or "strike zone." In general, a "strike zone" is an area through which a pitched ball must pass to be called a strike. The aperture 28 may, for example, extend substantially between armpits and knees of the batter in a vertical direction.

The net 30 captures pitched balls impacting the barrier member 22 within the strike zone, thereby indicating whether a pitched ball is within the strike zone. The barrier member 22 tends to keep pitched balls that miss the strike zone in a defined playing area. The game apparatus 20 is suitable for use on many different types of playing surfaces and for play with "backyard safe" variations of baseball such at Wiffle®Ball, Nerf® (Nerf® is a trademark of Hasbro, Inc., Pawtucket, R.I.), stickball, "IncrediBall" soft baseballs, and/or foam baseball equipment.

In the embodiment of FIGS. 1 and 2, the barrier member 22 is advantageously made form a wind permeable mesh fabric material. In other embodiments, the barrier member 22 may be made from, for example, a cloth material such as a canvas material.

In the embodiment of FIGS. 1 and 2, the aperture 28 is substantially rectangular, and is located in a central region of the barrier member 22. It is noted that the aperture 28 may be other shapes, such as round or triangular.

In the embodiment of FIGS. 1 and 2, the net 30 is made from a mesh fabric material, and has an open end and an opposed closed end. In general, the open end of the net 30 is adjacent the back surface 26 or the barrier member 22 and covers the aperture 28. The closed end of the net 30 extends behind (i.e., is remote from) the back surface 26. The net 30 is tapered such that the open end is larger than the closed end. In the embodiment of FIGS. 1 and 2, the open end of the net 30 is sewn to the perimeter of the aperture 28 in the barrier member 22 at the back surface 26. The closed end of the net 30 is connected to a rear portion of the frame 32.

In the embodiment of FIGS. 1 and 2, the frame 32 includes several inflatable members that are attached to one another such that air can flow freely between them. More specifically, the frame 32 may include two inflatable "U"-shaped members 34 and 36, and a substantially straight and inflatable base beam member 38 connected between the two inflatable "U"-shaped members 34 and 36.

In the embodiment of FIGS. 1 and 2, the inflatable "U"-shaped members 34 is oriented substantially vertically. The inflatable "U"-shaped members 36 is in contact with a supporting surface 40, and is oriented substantially horizontally. The barrier member 22 extends between the inflatable "U"-shaped member 34 and the inflatable base beam member 38. Each of the two inflatable "U"-shaped members 34 and 36 has two ends, and the ends of the two inflatable "U"-shaped members 34 and 36 are attached such that an angle "$\alpha$" of about 80 degrees is formed between the two inflatable "U"-shaped members 34 and 36. (See FIG. 2.) The inflatable base beam member 38 is connected between the ends of the two inflatable "U"-shaped members 34 and 36. In general, the inflatable "U"-shaped member 36 and the inflatable base beam member 38 provide a supporting base for the inflatable "U"-shaped member 34 to stand upright. The inflatable "U"-shaped member 34 and the inflatable base beam member 38 provide the shape and support for the barrier member 22.

The inflatable "U"-shaped member 36 includes a valve 52. The two inflatable "U"-shaped members 34 and 36 and the inflatable base beam member 38 are inflated by introducing air into the inflatable "U"-shaped member 36 via the valve 52. Air introduced into the inflatable "U"-shaped member 36 flows freely into the inflatable "U"-shaped member 34 and the inflatable base beam member 38. When inflated, the two inflatable "U"-shaped members 34 and 36 and the inflatable base beam member 38 take shape and become more rigid. The two inflatable "U"-shaped members 34 and 36 and the inflatable base beam member 38 are deflated by allowing air to escape from the inflatable "U"-shaped member 36 via the valve 52.

The two inflatable "U"-shaped members 34 and 36 and the inflatable base beam member 38 may be, for example, made of a flexible plastic material such as 18 gauge polyvinyl chloride (PVC) material. A protective sheet material may be extended between the inflatable "U"-shaped member 36 and the inflatable base beam member 38.

While the frame 32 may include elements as described above, the invention as claimed should not be limited strictly to this one embodiment, but should include alternative arrangements and embodiments such as could be devised by one skilled in the art given the teachings of the present invention.

In the embodiment of FIGS. 1 and 2, the game apparatus 20 includes an optional mounting skirt 42 attached to, and extending about, an outer edge of the inflatable "U"-shaped member 36. The mounting skirt 42 has multiple holes 44A–44E for securing the game apparatus 20 to the underlying surface 40. The holes 44A–44E are preferably reinforced (e.g., via grommets).

It is noted that using the game apparatus 20 in low wind speed conditions may not require that the game apparatus 20 be secured to the underlying surface 40. When the two inflatable "U"-shaped members 34 and 36 and the inflatable base beam member 38 are fully inflated, the game apparatus 20 is expectedly sufficiently sturdy and stable to remain in place during use. However, using the game apparatus 20 in windy conditions may require that the game apparatus 20 be secured to the underlying surface 40 via the mounting skirt 42.

In the embodiment of FIGS. 1 and 2, each of the holes 44A–44E is adapted to receive a stake, and the game apparatus 20 includes stakes 46A–46E corresponding to the respective holes 44A–44E. Each of the stakes 46A–46E is advantageously tethered to the mounting skirt 42 via a short cord. The mounting skirt 42 has hoops positioned adjacent the holes 44A–44E for attaching the cords to the mounting skirt 42. Connected to the mounting skirt 42 via the short cords, the stakes 46A–46E cannot be lost or misplaced between setups and breakdowns of the game apparatus 20.

In the embodiment of FIGS. 1 and 2, the game apparatus 20 also includes multiple containers 48A–48C attached to the mounting skirt 42. The container 48A is positioned along a right side of the inflatable "U"-shaped member 36, and the container 48C is positioned along a left side of the inflatable "U"-shaped member 36. The container 48B is positioned behind a curved central portion of the inflatable "U"-shaped member 36 that forms the rear portion of the frame 32. Each of the containers 48A–48C is adapted to be filled with a substance (e.g., a liquid such as water or a granular solid material such as sand) such that a weight of the substance helps hold the game apparatus 20 in place. The containers 48A–48C may be, for example, heat welded to the mounting skirt 42. The use of the containers 48A–48C is advantageous where the underlying surface 40 is impenetrable, or damage to the underlying surface 40 is to be avoided.

In the embodiment of FIGS. 1 and 2, each of the containers 48A–48C has a pair of openings at opposite ends each surrounded by a neck, and a pair of removable caps for sealing the openings. Each of the caps is advantageously attached to a corresponding neck via a short cord. Connected to the corresponding necked openings via the short cords, the caps cannot be lost or misplaced between setups and breakdowns of the game apparatus 20.

In the embodiment of FIGS. 1 and 2, the mounting skirt 42 has a portion 50 adapted to receive an object. A weight of the object positioned on the portion 50 helps hold the game apparatus 20 in place. In one embodiment, the portion 50 is dimensioned to receive a cooler.

In addition to the game apparatus 20, a carry bag 54 and an inflation pump 56 are shown in FIG. 1. The carry bag 54 is large enough to hold the components of the game apparatus 20 when the two inflatable "U"-shaped members 34 and 36 and the inflatable base beam member 38 are deflated and the components are folded and/or rolled up. The carry bag 54 may be used to store and transport the game apparatus 20. The two inflatable "U"-shaped members 34 and 36 and the inflatable base beam member 38 may be inflated by connecting the inflation pump 56 to the valve 52 and activating the inflation pump 56, thereby introducing air into the inflatable "U"-shaped member 36 via the valve 52.

Figure 3:
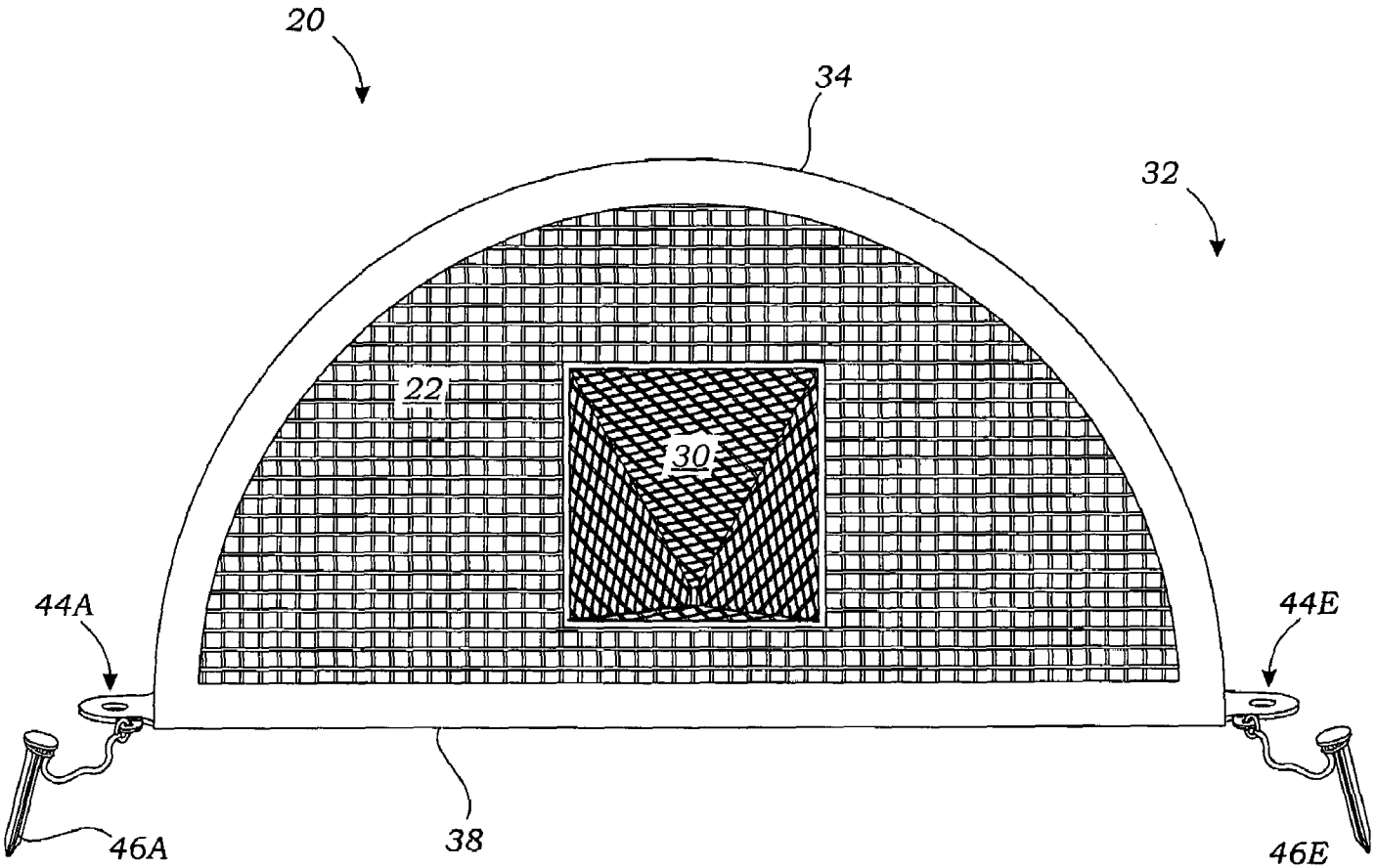
FIG. 3 is a front elevation view of the game apparatus of FIG. 1.
Figure 4:
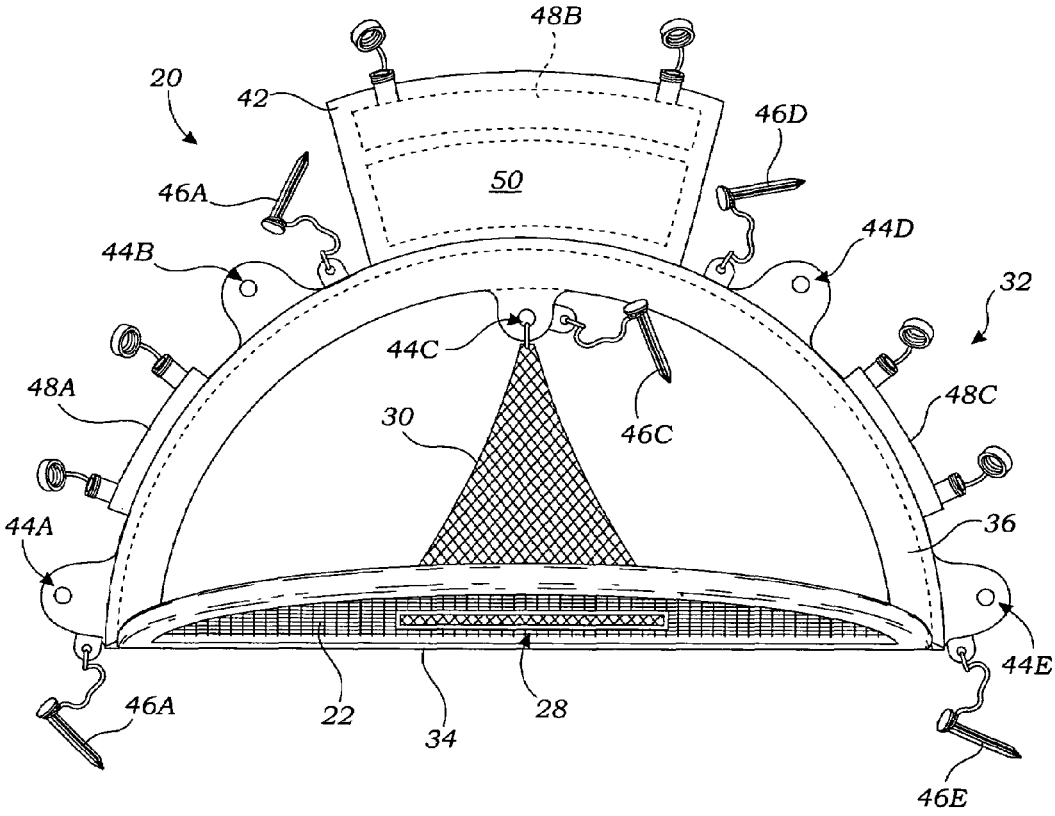
FIG. 4 is a top plan view of the game apparatus of FIG. 1.

FIG. 3 is a front elevation view of the game apparatus 20 of FIG. 1. FIG. 4 is a top plan view of the game apparatus 20 of FIG. 1.

Figure 5:
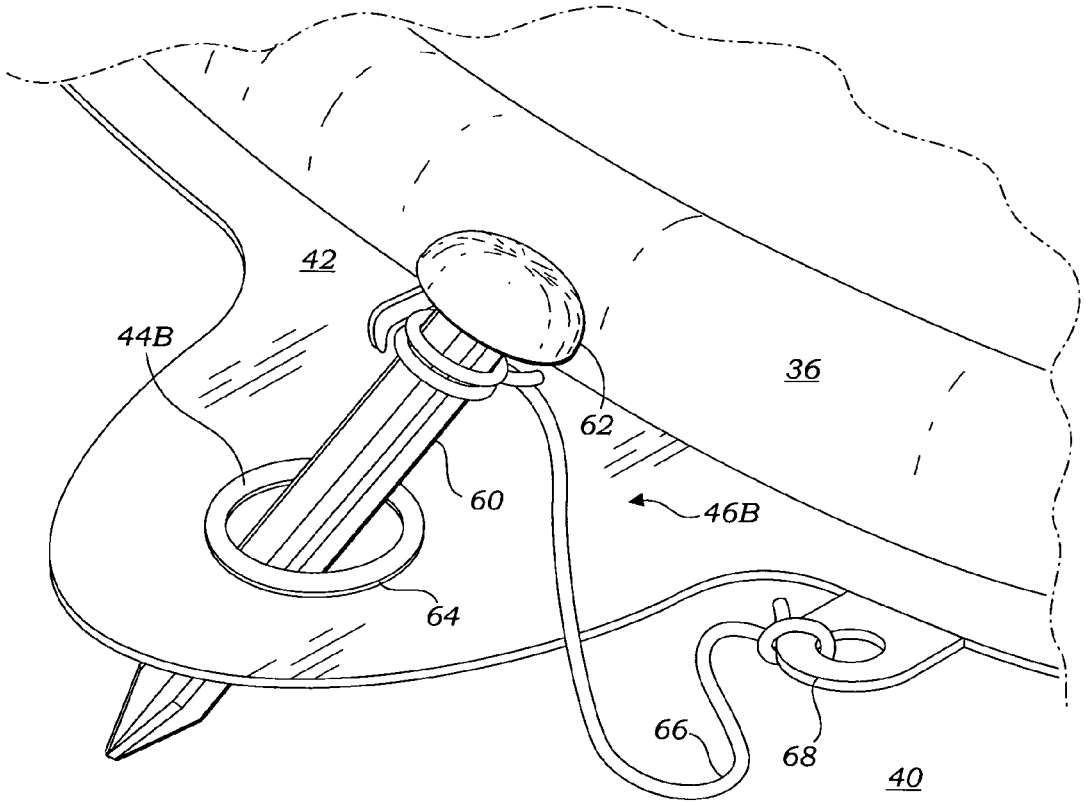
FIG. 5 is a view of a shaft of a stake being passed through a corresponding hole in an optional mounting skirt of the game apparatus of FIG. 1 and into an underlying surface in order to secure the game apparatus to the underlying surface.

FIG. 5 is a view of a shaft 60 of the stake 46B of FIGS. 2 and 4 being passed through the corresponding hole 44B in the mounting skirt 42 and into the underlying surface 40 in order to secure the game apparatus 20 of FIG. 1 to the underlying surface 40. A head 62 of the stake 46B is wider than a diameter of the hole 4413 and therefore prevents movement of the mounting skirt 42. In FIG. 5 the hole 44B is reinforced via a grommet 64. The stake 46B is advantageously tethered to the mounting skirt 42 via a short cord 66, and the mounting skirt 42 has a hoop 68 positioned adjacent the hole 44B for attaching the cord to the mounting skirt 42.

Connected to the mounting skirt 42 via the short cord 66, the stake 46B cannot be lost or misplaced between setups and breakdowns of the game apparatus 20. As illustrated in FIGS. 1–2 and 4 and described above, the other stakes 46A and 46C–46E are also advantageously tethered to the mounting skirt 42 via short cords, and the mounting skirt 42 has hoops positioned adjacent the corresponding holes for attaching the cords to the mounting skirt 42.

Figure 6:
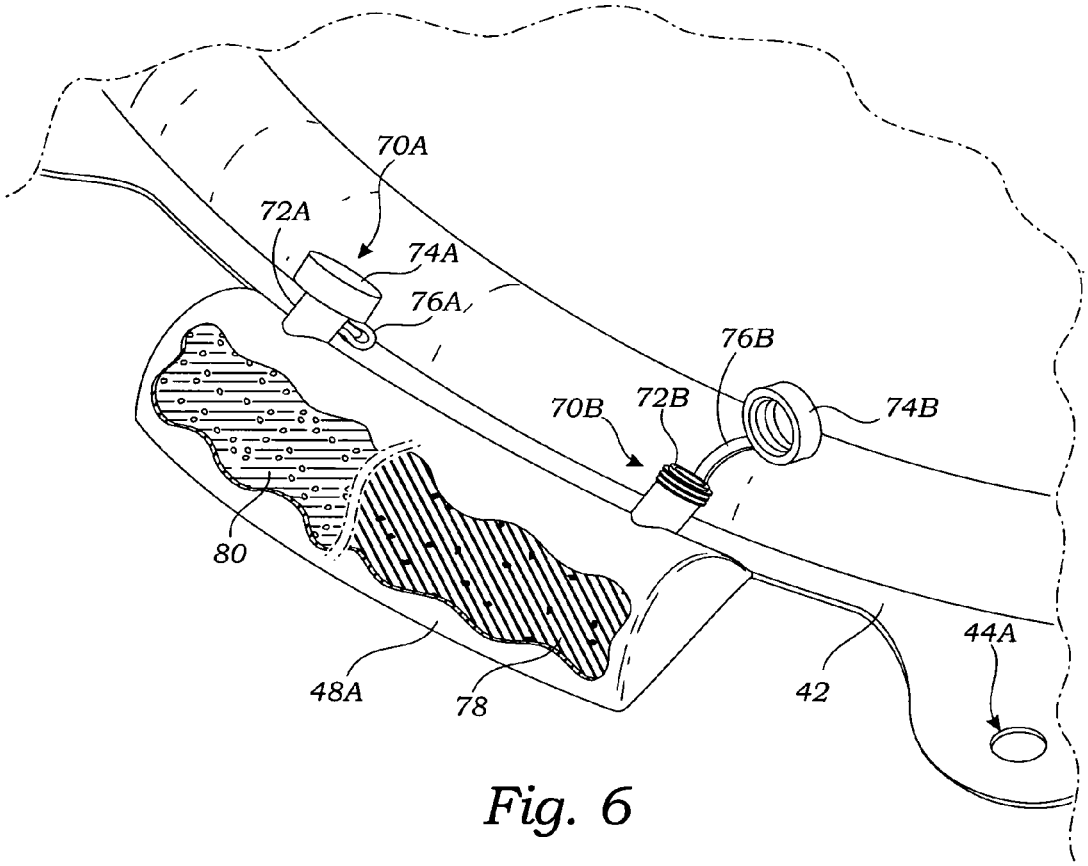
FIG. 6 is a view of an optional container of the game apparatus of FIG. 1 that may be used to help secure the game apparatus to the underlying surface.

FIG. 6 is a view of the container 48A of FIGS. 2 and 4. The container 48A has a pair of openings 70A and 70B at opposite ends. A neck 72A surrounds the opening 70A, and a neck 72B surrounds the opening 70B. A pair of removable caps 74A and 74B are provided for sealing the respective openings 70A and 70B. The cap 74A is attached to the corresponding neck 72A via a short cord 76A, and the cap 74B is attached to the corresponding neck 72B via a short cord 76B. Connected to the corresponding necks 72A and 72B via the short cords 76A and 76B, the caps 74A and 74B cannot be lost or misplaced between setups and breakdowns of the game apparatus 20. As illustrated in FIGS. 2 and 4 and described above, the caps of the other containers 48B and 48C are also attached to corresponding necks via short cords.

The container 48A may be filled by removing (e.g., unscrewing) the cap 74A from the opening 70A (and/or the cap 74B from the opening 70B) and pouring either a liquid such as water, labeled "78" in FIG. 6, or a granular solid such as sand, labeled "80" in FIG. 6, into the container 48A via the opening 70A (and/or the opening 70B). The container 48A may then be sealed by installing (e.g., screwing) the cap 74A (and/or the cap 74B). The weight of the liquid or granular solid in the container 48A helps to prevent movement of the mounting skirt 42. The other containers 48B and 48C may be filled in a similar fashion. As described above, the use of the containers 48A–48C is advantageous where the underlying surface 40 is impenetrable, or damage to the underlying surface 40 is to be avoided.

Figure 7:
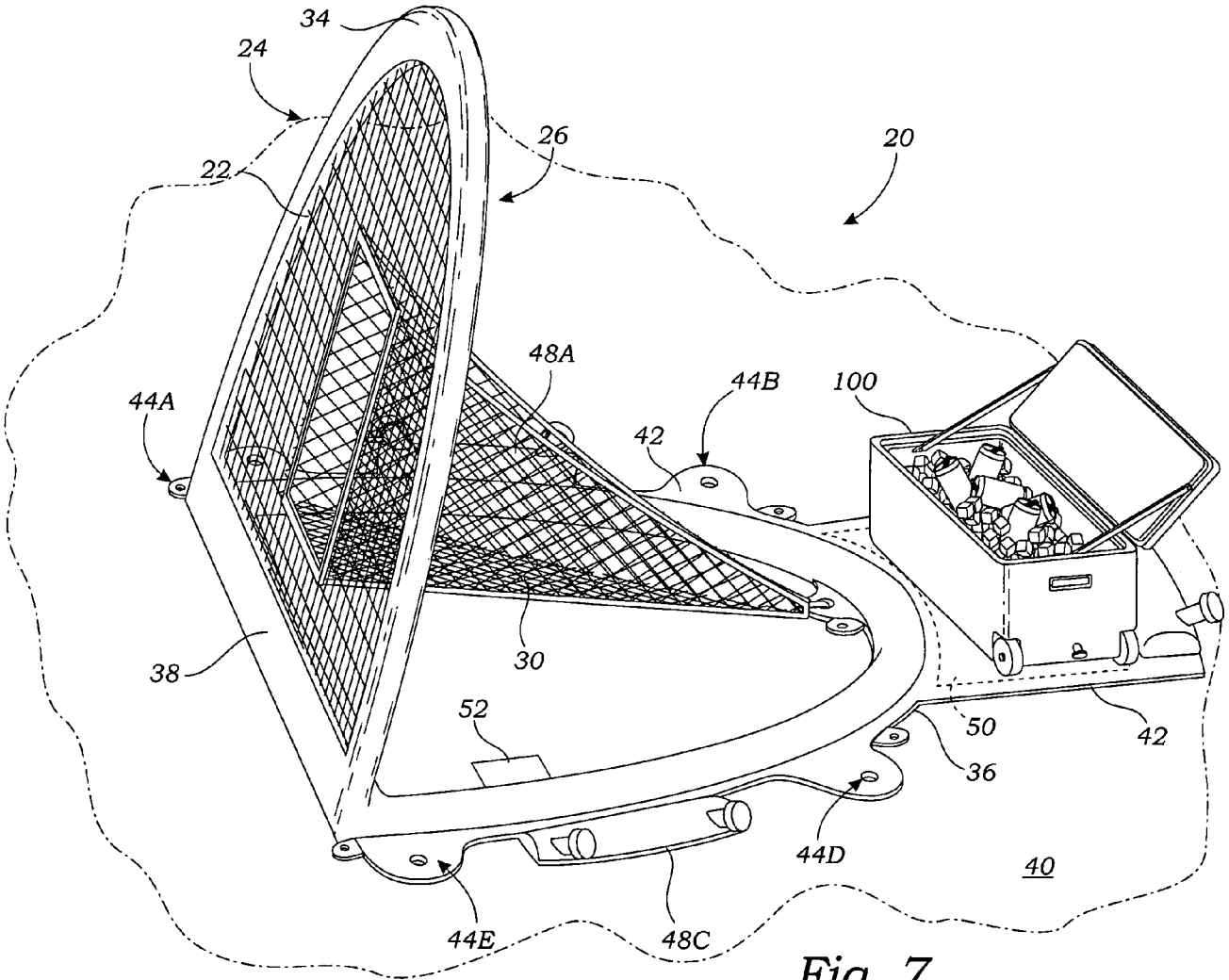
FIG. 7 is a perspective view of a rear portion of the game apparatus of FIG. 1 wherein a cooler is positioned on a portion of the mounting skirt to help secure the game apparatus to the underlying surface.

FIG. 7 is a front elevation view of the game apparatus 20 of FIG. 1 showing dimensions of a particular embodiment. In the embodiment of FIG. 7, the inflatable base beam member 38 has a width dimension of about 8 feet, and the inflatable "U"-shaped member 34 has a height of about 6 feet. The aperture 28 in the barrier member 22 is a rectangle having a width of about 20 inches and a height of about 30 inches. A bottom edge of the aperture 28 is elevated about 16 inches above the underlying surface 40. The aperture 28 may, for example, define a rectangular target zone or strike zone having a width of about 20 inches, a height of about 30 inches, and elevated about 16 inches above the underlying surface 40.

In the preferred embodiment, the side edges of the aperture 28 are about 38 inches from corresponding outer edges of the ends of the inflatable base beam member 38. A top edge of the aperture 28 is about 26 inches below an uppermost portion of the inflatable "U"-shaped member 34, and about 46 inches above the underlying surface 40. The inflatable base beam member 38 preferably has a width dimension of about 8 feet, and the inflatable "U"-shaped member 34 has a height of about 6 feet. The inflatable "U"-shaped member 36 preferably has a depth dimension of about 5 feet, and a part of mounting skirt 42 including the portion 50 has a dimension of about 3 feet. Thus the frame 32 and the mounting skirt 42 preferably have a total depth dimension of about 8 feet.

It is noted that the size and shape of the frame 32 and the aperture 28 are not limited to the embodiments shown and described herein. Other sizes and shapes can be devised by those skilled in the art. For example, a rectangular shape may allow the barrier member 22 to stop more pitched balls that miss the aperture 28. Moreover, the size of the game apparatus 20 could be enlarged or reduced to accommodate different players. For example, a smaller version could be used for play by small children.

FIG. 7 is a perspective view of a rear portion of the game apparatus 20 of FIG. 1 wherein a cooler 100 is positioned on the portion 50 of the mounting skirt 42. A weight of the cooler 100 helps prevent the game apparatus 20 from moving during use due to wind or impacts of pitched objects. It is noted that other objects, such as a lawn chair or an equipment bag, may also be placed on the portion 50 of the mounting skirt 42 to help secure the game apparatus 20 to the underlying surface 40.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A game apparatus comprising:

a barrier member having an aperture;

a net positioned to cover the aperture;

a frame having at least one inflatable member for supporting the barrier member in a generally planar and substantially vertical orientation when inflated, wherein the frame comprises two inflatable "U"-shaped members and an inflatable base beam member connected between the two inflatable "U"-shaped members, and wherein the barrier member extends between one of the two inflatable "U"-shaped members and the inflatable base beam member; and wherein each of the two inflatable "U"-shaped members has two ends, and wherein the ends of the two inflatable "U"-shaped members are attached such that an angle of about 80 degrees is formed between the two inflatable "U"-shaped members.

2. The game apparatus of claim 1, further comprising a mounting skirt attached to, and extending about, an outer edge of one of the two inflatable "U"-shaped members, and wherein the mounting skirt comprises a plurality of holes for securing the game apparatus to an underlying surface.

3. The game apparatus of claim 2, further comprising a plurality of containers attached to the mounting skirt, wherein each of the containers is adapted to be filled with a substance such that a weight of the substance helps hold the game apparatus in place.

4. The game apparatus of claim 2, wherein a portion of the mounting skirt is adapted to receive an object, wherein a weight of the object helps hold the game apparatus in place.

* * * * *